US006619395B2

(12) United States Patent
Spross

(10) Patent No.: US 6,619,395 B2
(45) Date of Patent: Sep. 16, 2003

(54) METHODS FOR DETERMINING CHARACTERISTICS OF EARTH FORMATIONS

(75) Inventor: Ronald L. Spross, Humble, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 114 days.

(21) Appl. No.: 09/970,370

(22) Filed: Oct. 2, 2001

(65) Prior Publication Data

US 2003/0062158 A1 Apr. 3, 2003

(51) Int. Cl.[7] ..... E21B 47/00; G01V 5/04; G01V 5/12

(52) U.S. Cl. ..... 166/254.2; 250/254; 250/269.3

(58) Field of Search ..... 166/254.2; 250/254, 250/269.1, 269.3, 269.4, 269.6, 269.7, 269.8

(56) References Cited

U.S. PATENT DOCUMENTS 5,017,778 A 5/1991 Wraight ..... 250/254
5,091,644 A 2/1992 Minette ..... 250/254
5,397,893 A 3/1995 Minette ..... 250/254
5,451,779 A 9/1995 Spross et al. ..... 250/266
5,473,158 A 12/1995 Holenka et al. ..... 250/254
5,486,695 A 1/1996 Schultz et al. ..... 250/261
5,513,528 A 5/1996 Holenka et al. ..... 73/151

*Primary Examiner*—David Bagnell
*Assistant Examiner*—Brian Halford
(74) *Attorney, Agent, or Firm*—Fish & Richardson P.C.

(57) ABSTRACT

A method for measuring one or more characteristics of an earth formation whereby energy is emitted circumferentially about a borehole into the formation, and the amount reflected back is detected during a plurality of sample periods. The samples are grouped into two or more groups by the azimuthal sector in which the sample was collected. Within a group, each sample is mathematically weighted according to the standoff of the detector from the borehole wall when the sample was taken. Within a group, the weighted samples are summed to produce a weighted total amount of energy detected within a sector. The weighted total is then transformed into the one or more characteristics.

20 Claims, 1 Drawing Sheet

METHODS FOR DETERMINING CHARACTERISTICS OF EARTH FORMATIONS

BACKGROUND OF THE INVENTION

1. Field of the Invention

The present invention relates to the investigation of subsurface earth formations, and more particularly to methods for determining one or more characteristics of an earth formation using a borehole logging tool.

2. Description of the Related Art

When drilling an oil and gas well, it is often desirable to run a logging while drilling (LWD) tool in-line with the drill string to gather information about the subsurface formations while the well is being drilled. The LWD tool enables the operators to measure one or more characteristics of the formation around the circumference of the borehole. Data from around the borehole can be used to produce an image log that provides the operator an "image" of the circumference of the borehole with respect to the one or more formation characteristics. The data can also be accumulated to produce a value of the one or more formation characteristics that is representative of the borehole circumference.

One type of LWD tool incorporates gamma-gamma density sampling to determine one or more formation characteristics. In gamma-gamma sampling, gamma rays are emitted from a source at the tool and scatter into the formation. Some portion of the radiation is reflected back to the tool and measured by one or more detectors. Formation characteristics, including the formation density and a lithology indicator such as photoelectric energy (Pe), can be inferred from the rate at which reflected gamma radiation is detected. Generally, the more radiation detected by the detectors the lower the density of the formation.

The amount of radiation detected is measured in counts, and is usually expressed in counts per unit time, or count rate. The statistical precision of the count rate is a function of the total counts acquired in a measurement. Precise measurements of low count rates require a longer acquisition time than equally precise measurements of high count rates. Generally, a measurement period of between 10 and 20 seconds is required to obtain a sufficient amount of data for a precise measurement of a formation characteristic. However, typical drilling rates require that the rotational period of the drill string, onto which the LWD tool is mounted, be less than one second. Thus, count rate data from several rotations must be combined to achieve a precise measurement.

In ideal conditions, the counts collected from the several rotations can be summed linearly. Many factors affect the accuracy of the measured count rate both at different points around the circumference of the borehole and at the same point from rotation to rotation. Therefore, various methods have been developed to account for the inaccuracy in the count rates as they are built up for several rotations. The effectiveness of such methods ultimately affects the accuracy of the assessment of the one or more formation characteristics.

One factor that affects the accuracy of the count rate data accumulated during the measurement period is the proximity of the detector to the borehole wall, or standoff. The standoff of the tool can vary azimuthally around the circumference of the borehole, as well as at the same point from rotation to rotation. When the standoff is low, and the detector is close to the borehole wall, the detector is reading radiation reflected primarily from the formation. When the standoff is high, drilling mud that is continually being circulated about the tool fills the annular space between the detector and the borehole wall. The detector in this case is then reading radiation reflected from the formation and the drilling mud, and the resultant count rate is not representative of the formation.

Typically, if the borehole is in gauge and of uniform circular cross-section, the standoff will be substantially consistent around the circumference of the borehole. With consistent standoff or small variations in standoff, known statistical methods can make adequate compensation for the effect of the drilling mud. However, many situations arise where the standoff can vary substantially for different azimuthal angles. More substantial variations in standoff impact the accuracy of the count rate and are more difficult to compensate, particularly as the offset becomes large. For example, the borehole gauge can be elliptical, and if the tool remains centered in the bore the standoff would be the greatest at the major axis of the ellipse. Thus, the mud would have a greater affect on the count rate when the detector is near the major axis, and a lesser affect on the count rate when the detector is near the minor axis. In another example, the gauge of the borehole can be oversized, though circular, elliptical, or otherwise. In such a situation, the tool may walk around the borehole tending to contact the borehole wall at many different points. In a borehole that is highly deviated or almost horizontal, the tool may sometimes climb the sidewalls. Irregular variations that occur when the tool walks in the borehole are difficult to compensate, especially when the standoff changes are large.

Another factor that must be accounted for, particularly when a formation characteristic representative of the borehole circumference is desired, is the variation in the measured parameter at different points around the circumference of the borehole. Typically, earth formations are sedimentary, and thus consist of generally homogenous horizontal layers. Occasionally, however, the layers will have discontinuities of notably different characteristics. The borehole may intersect the discontinuity such that a portion of the borehole circumference has different characteristics than the remainder. Even without a discontinuity, the characteristics of the borehole may be different in different portions of the circumference. For example, a highly deviated borehole may cross a horizontal boundary from one formation to the next at an angle. In some cases, a portion of the borehole circumference is representative of one formation while the remainder is representative of another formation. Such variations in formation characteristics can usually be seen in an image log.

Known techniques that attempt to compensate for perturbations in the count rate have tended to concentrate on achieving an accurate representative value of the formation characteristic for the borehole circumference, rather than an accurate borehole image. As such, the known techniques have relied on generalizations of the data in their methods. For example, U.S. Pat. No. 5,397,893 to Minette, discloses a method that groups or bins data by azimuthal angle, preferably by quadrant, or by the amount of standoff when the measurement is taken. The data that is grouped by azimuthal angle, that is the most useful for determining a borehole image, does not take in to account actual standoff. The data grouped by standoff is not associated with azimuthal angle to enable correlation with its position in the borehole.

Another system disclosed in U.S. Pat. No. 5,473,158 to Holenka et al. teaches a method whereby data is also grouped by quadrant. The statistical distribution of each quadrant is analyzed, and an error factor for each quadrant is calculated. The error factor is then applied to the entire quadrant, rather than the individual data grouped therein. Such generalization by quadrant is not ideal for devising a borehole image nor a representative formation characteristic of the borehole.

Therefore, there is a need for a method of measuring one or more characteristics of formation that more accurately accounts for perturbations in the measurements. Further, it is desirable that this method enable accurate imaging of the entire circumference of the borehole.

SUMMARY OF THE INVENTION

The invention is drawn to a method of measuring one or more characteristics of an earth formation that more accurately accounts for variations in the borehole in the measurements. The invention further allows accurate imaging of the entire circumference of the borehole.

The method enables determining at least one characteristic of an earth formation surrounding a borehole using a rotating logging tool. The logging tool is of a type having an emitter for emitting energy into the earth formation. Further, the logging tool is of a type having at least one detector for detecting energy reflected from the earth formation. The method includes detecting an amount of energy reflected from the earth formation during a plurality of sample periods with the detector to produce a plurality of samples corresponding to the sample periods. The duration of each sample period is shorter than one half of the time required for the tool to complete a rotation. An azimuthal angle of the detector is measured in at least one of the sample periods. The standoff of the detector from the wall of the borehole is measured in at least one of the sample periods. Each of the samples are sorted into one of a plurality of groups. Each of the groups is representative of a particular azimuthal sector of the borehole. Within a group, the samples are mathematically weighted according to standoff. Within a group, the weighted samples are mathematically summed to achieve a weighted sample total detected within an azimuthal sector. Within a group, the weighted sample total is divided by the total duration of the sample periods in the group to determine an detection rate for the sector. The detection rate is transformed into a representation of a characteristic of the formation.

The method also enables determining at least one characteristic of an earth formation surrounding a borehole and using a rotating logging tool, but without a specific standoff measurement. The logging tool is of a type having an emitter for emitting energy into the earth formation. Further, the logging tool is of a type having at least one detector for detecting energy reflected from the earth formation. The method includes detecting an amount of energy reflected from the earth formation during a plurality of sample periods with the detector to produce a plurality of samples corresponding to the sample periods. The duration of each sample period is shorter than one half of the time required for the tool to complete a rotation. An azimuthal angle of the detector is measured in at least one of the sample periods. Each of the samples are sorted into one of a plurality of groups. Each of the groups is representative of a particular azimuthal sector. Within a group, the mean number of the samples is calculated. Within a group, a theoretical standard deviation of the samples is calculated. Within a group, an actual standard deviation of the samples is calculated. If the difference between the theoretical standard deviation and the actual standard deviation is above a give value, the method includes mathematically weighting the samples according to the deviation of the sample from the mean and mathematically summing the weighted samples to determine a weighted sample total for a sector. If the difference between the theoretical standard deviation and the actual standard deviation is below a given value, the method includes mathematically summing the samples to achieve a total amount of energy detected within a sector. Within a group, dividing one of the sample total and the weighted sample total by the total duration of sample periods of the group to determine an detection rate for the sector. The detection rate is transformed into a representation of a characteristic of the formation.

An advantage of the invention is that azimuthal information and standoff information is collected along with the energy data, enabling weighting the data within an azimuthal sector to compensate for perturbations in the data collected in a much more precise manner than the known systems. This enables compensation for variances in standoff that change with azimuthal tool position and from rotation to rotation. The ultimate measured characteristic is more accurate.

An additional advantage of the invention is that, because the data is associated with the angular position of tool, an accurate image of the borehole circumference can be developed. Incorporating angular position into the analysis enables the operator to see when the tool is passing through formation boundaries and the relative position of the tool to the boundary.

An additional advantage of the invention is that the information gathered during LWD can be used, for example, in geo-steering the drilling to direct the well to a target more accurately than would be possible with only geometric information of the type and resolution derived from surface seismic testing.

Furthermore, the invention provides embodiments with other features and advantages in addition to or in lieu of those discussed above. Many of these features and advantages are apparent from the description below with reference to the following drawing.

BRIEF DESCRIPTION OF THE DRAWING

Various objects and advantages of the invention will become apparent and more readily appreciated from the following description of the presently preferred exemplary embodiments, taken in conjunction with the accompanying drawing of which.

DETAILED DESCRIPTION OF THE INVENTION

Figure 1:
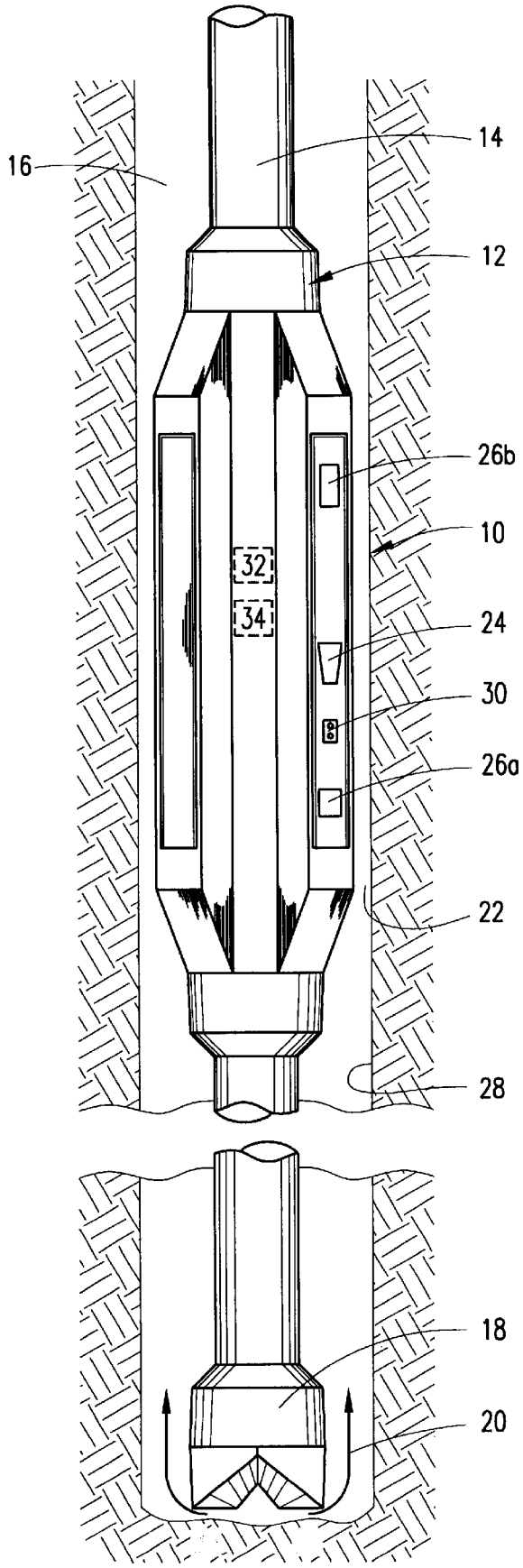
FIG. 1 is a schematic of a drill string having a logging while drilling tool and drill bit residing in a borehole.

Referring first to FIG. 1, a logging while drilling (LWD) tool 10 is generally housed in a drill collar 12 that is threadingly secured in-line with a drill string 14. The drill string 14 is a tubular body extending from a drilling rig (not shown) into an earth formation, axially thorough a borehole 16. A drill bit 18 is secured to one end of the drill string 14. The drill string 14 is rotated to turn the bit 18, thereby drilling through the earth formation and forming the borehole 16. The borehole 16 may be drilled substantially vertical through the earth formation or may be drilled at angles approaching or at horizontal. A borehole 16 that is drilled at an angle other than vertical is generally referred to as being deviated. During the drilling operations, drilling mud 20 is pumped down from the surface through the drill string 14 and out of the bit 18. Drilling mud 20 then rises back to the surface through an annular space 22 around the drill string 14. Data from the LWD tool 10 can be transferred to the surface electrically, such as by wireline, by sending pressure pules through the drilling mud 20, or any other method known in the art.

The LWD tool 10 has an energy source 24 and energy detectors 26 on or near its perimeter. In one embodiment, the source 24 emits gamma radiation about the circumference of the borehole 16 and into the surrounding earth formation as the tool 10 rotates on its axis. Radiation entering the formation is scattered and some portion is reflected, or back-scattered, towards the tool 10. Detectors 26 are of a type for detecting counts of back-scattered gamma radiation, and can detect back-scattered gamma radiation from one or more energy intervals.

While the present invention is equally applicable to a LWD tool 10 having one or multiple detectors, LWD tools typically have two detectors, a short space detector 26*a* and a long space detector 26*b*. The short space detector 26*a* is positioned closer to the source 24 than the long space detector 26*b*. Thus, back-scattered gamma radiation that is detected by the short space detector 26*a* has generally traversed a shorter distance through the formation than back-scattered gamma radiation that is detected by the long space detector 26*b*. Because of the shorter path traveled by the radiation detected with the short space detector 26*a*, the short space detector 26*a* has a greater sensitivity to conditions near the tool 10, such as standoff, than the long space detector 26*b*. Using both a short space detector 26*a* and a long space detector 26*b* provides two different measurements that can be correlated, for example with quantitatively derived rib-spine plots, to achieve a more accurate measurement of the radiation back-scattered from the formation. Various correlation methods are well known in the art and thus not described herein.

A LWD tool 10 for use with this invention additionally has a standoff sensor 30 for measuring the distance between the tool 10 and the borehole wall 28, or standoff. The standoff sensor 30 can be, for example, of an acoustical type that measures the round trip travel time of an acoustic wave from the sensor 30 to the borehole wall 28 and back to the sensor to determine the standoff. Other types of standoff sensors can also be used.

An angle sensor 32 for sensing the azimuthal position of the tool 10, and correspondingly the detectors 26, is provided in the LWD tool 10. Alternately, the angle sensor 32 can be provided nearby the LWD tool 10 in-line with the drill string 14. The angle sensor 32 can be, for example, a system of magnetometers that sense the earth's magnetic field, and reference the relative orientation of the tool 10 to the magnetic field to track its azimuthal position. Another example of an angle sensor 32 can be an accelerometer that senses the earth's gravitational pull, and references the relative orientation of the tool 10 to the gravitational pull to track the orientation of the tool 10. In some cases, the angle sensor 32 may incorporate both magnetometers and accelerometers. Other types of angle sensors can also be used in combination with, or alternatively to, the aforementioned types of angle sensors.

A processing unit 34 is provided either within the LWD tool 10 or remote to the LWD tool 10 and in communication with the tool 10. The processing unit operates the various sensors 30, 32 and detectors 26 in accordance with the method described below, and can be configured to store and process the collected data.

The LWD tool 10 is used to collect data that can be transformed into a representation of the one or more formation characteristics. The data can be represented as an image log or as a representative formation characteristic. The image log is an indication of the formation characteristic at different points around the circumference of the borehole 16 that enables the operator to see an "image" of the borehole 16 circumference in terms of the particular characteristic. The representative characteristic is a representation of the particular characteristic over the circumference of the borehole 16. If the entire circumference of the borehole 16 is not homogeneous, one feature of this invention is that more than one representative formation characteristic can be derived for each of the dissimilar regions. Generally, the representative formation characteristic calculated for a substantially homogenous portion of a borehole is a more accurate depiction of the formation characteristic than the formation characteristic from the individual sectors in the image log. This is because the representative characteristic is derived using most or all of the data from the homogenous portion, whereas the characteristic of each sectors is calculated using only the data collected in a given sector.

In use, the LWD tool 10 rotates with the drill string 14 in the borehole 16. Data for use in determining the one or more formation characteristics is gathered during a given length of time, herein referred to as a time series. The length of the time series is a function of how much data will be required to achieve an accurate measurement of the one or more formation characteristics. Typically, the time series is about 10 to 20 seconds; however, both longer and shorter time series are anticipated within the method of this invention.

The source 24 emits gamma radiation during at least the given time series. The radiation is emitted radially and in a sweeping fashion about the circumference of the borehole 16 as the tool 10 rotates. Meanwhile, the detectors 26 detect counts of radiation back-scattered from the formation. The detectors 26 are operated to detect radiation primarily from one or more energy intervals chosen to optimize the accuracy of the given characteristic being measured. For gamma-gamma density measurements, the energy intervals are typically subsets of an energy range between 50 keV and 450 keV. In an embodiment utilizing both a short space detector 26*a* and a long space detector 26*b*, each can be operated to collect data from one or more different energy intervals.

The detectors 26 are also operated to detectback-scattered radiation during a plurality of rapid sample periods, rather than continuously throughout the time series. Each rapid sample consists of data from each of the detectors 26 in the one or more energy intervals. The duration of the rapid sample periods is much shorter than a single rotation of the tool 10. Preferably, the duration of the rapid sample periods is shorter than half of the tool rotational period. For example, in a time series of 20 seconds, 1000 rapid samples of 20 milliseconds each may be collected. More or fewer rapid samples of a given duration can be taken dependent on the accuracy of the measurement desired. As will be discussed in more detail below, the data can be grouped and analyzed by the azimuthal sector from which it was detected. The duration of the rapid sample periods is preferably shorter than the time spent by the detectors 26 in the azimuthal sector per rotation of the tool 10.

Because the sampling period is short, the conditions during each of the rapid sample periods, such as standoff or variations in the formation, are substantially constant within a rapid sample. This minimizes noise associated with variation in standoff or formation characteristics around the borehole circumference, because the counts taken during a given rapid sample can be accurately associated with the conditions in which they were detected.

The azimuthal position of the tool 10, and correspondingly the detectors 26, is taken as the tool 10 rotates in the borehole. Preferably, azimuthal position is measured with every rapid sample, or often enough that the azimuthal position of the tool 10 can be determined for each of the rapid samples. After collection, the azimuthal tool position measurements can be associated with corresponding rapid samples and stored for the analysis described in detail below.

Other measurements, for example the standoff of the tool 10 or mud density, may also be measured regularly. The standoff is preferably measured by the standoff sensor 30 one or more times during each rapid sample, but can be measured less often to conserve power. The standoff measurements taken during each of the rapid samples can be associated with the corresponding rapid sample and stored for analysis.

The rapid samples detected during a time series can be divided into groups representative of the azimuthal position of the tool 10 in borehole 16 when the rapid sample was detected. Each group preferably corresponds to one of a plurality of azimuthal sectors of the borehole 16. The sectors are preferably of equal subtended angle, and the number of sectors, and corresponding number of groupings, is dependent on the particular characteristics being measured.

As is discussed in more detail below, each of the groupings will yield one or more formation characteristics corresponding to an azimuthal sector. Thus, if four groupings are used, the method described herein can yield four values of the formation characteristic for the borehole 16. Each of the four values is an image point representative of one of the four sectors that can be used in an image log. If more image points are desired, more groupings may be used. For example, the rapid samples can be divided among sixteen sectors to yield sixteen values of the measured characteristic around the borehole 16. More or fewer sectors, and thus groupings, can be used depending on the specific application.

For convenience of reference, the azimuthal sectors can be referenced relative to a position in the borehole 16. For example, if the borehole 16 is deviated, the borehole 16 will have a "high side" corresponding to the highest portion of the borehole 16. The angular position of the detectors 26 can be determined relative to the high side using the angle sensor 32 or another sensor (not shown) provided particularly for this purpose, such as an accelerometer or magnetometers. Referencing the sectors to a borehole position enables the operators to easily correlate the resulting image logs to the borehole and compare image logs derived from different time series.

After the data from each of the rapid sample periods has been recorded and grouped by azimuthal sector, the data within each sector is evaluated to determine whether it must be compensated to account for variations in standoff. The compensation method is described in more detail below. Within each grouping, data is analyzed according to the energy interval in which it was detected. Thus, within a grouping, data from a given energy interval is accumulated to produce a total number of counts detected in the energy interval. A count rate for the given energy interval is derived from the total number of counts in the energy interval and the total time for the samples in the group. The count rate from one or more energy intervals can then be transformed into one or more formation characteristics representative of the sector. Repeating this process for each of the sectors results in a value representative of the one or more formation characteristics for each of the sectors that is more accurate than produced by other known methods. The same formation characteristic from two or more, and preferably all, of the sectors comprises an image log of the borehole in terms of the particular formation characteristic. The count rate from one or more energy intervals and one or more of the sectors can be used, together with known methods, to derive a representative characteristic of the borehole.

In evaluating the data within each sector to determine whether it must be compensated to account for variations in standoff, many methods known in the art can be used. For example, one method that can be used is a statistical method. In such a statistical method, a theoretical standard deviation and an actual standard deviation of the counts from an energy interval within each sector is compared. The theoretical standard deviation can be calculated as follows:

$$\sigma_{Thoretical-\sqrt{\overline{C}_{Sample}}} \tag{1}$$

wherein $\overline{C}_{Sample}$ is the mean number of counts of the energy interval per rapid sample in the sector. The actual standard deviation is calculated as follows:

$$\sigma_{Actual} = \sqrt{\frac{1}{n-1}\sum_{i=0}^{n-1}(C_i - \overline{C}_{Sample})^2} \tag{2}$$

wherein n is number of rapid samples in a sector, and $C_i$ represents the total number of counts of the energy interval in each rapid sample i=0, 1, 2 . . . n−1.

If the ratio of the actual standard deviation to the theoretical standard deviation for a particular sector approaches unity, this indicates that the variation in standoff is small. Thus, the counts of an energy interval from the sector can be linearly summed and the count rate readily calculated. If the ratio of the actual standard deviation to the theoretical standard deviation of a particular sector is substantially above one, the standoff can be assumed to be varying excessively and compensation is required. A threshold value of the ratio can be established, over which the standoff is considered to be varying excessively for an accurate measurement. Thus, if the ratio is below the threshold value, the counts are linearly summed, if the ratio is above the threshold value the counts are compensated as is described in more detail blow. The threshold value can be above 1, and can be chosen to account for statistical variation among individual successive determinations of the ratio.

Thus, if it is determined that the position of the tool 10 is relatively stable in the hole as it rotates, or the standoff of the tool 10 is a repeating and regular function of the azimuthal angle, the total number of counts detected for an energy interval in a given sector can be calculated by linearly summing the number of counts from the energy interval in each rapid sample from the sector. Also, if the diameter of the borehole 16 is circular and close in diameter to gauge of the drill bit 18, the tool 10 will be substantially in contact with the borehole wall 28 during rotation and have little to no standoff.

The total time span of detection for each sector can be calculated by summing the time of each rapid sample from within a sector. It is important to note that rapid sample time total may be different between sectors and thus must be calculated for each sector. The differences in the total detection time can stem from several factors, such as a number of rapid sample periods that is not evenly divisible into the chosen number of sectors or torsional flexure in the drill string effecting an inconsistent rotational speed of the tool.

Finally, after the total time of detection within a sector is determined, the count rate for a given energy interval of a sector can be calculated by dividing the total number of counts for the energy interval by the total time span of detection within the sector. The count rates from one or more energy intervals can be transformed into a representation of the one or more formation characteristics, for example density or Pe. The same formation characteristic from two or more sectors can then be used as image points in an image log of the borehole 16 with respect to the particular formation characteristic.

If the position of the tool 10 in the borehole 16 changes, for example, the tool 10 is walking in the borehole 16, other analysis must be performed to compensate for the changes in standoff. For example, density is a non-linear function of the count rate, and linearly summing the counts when there is excessive variation in standoff will introduce great error into the calculation. One compensation strategy that can be used is described below.

As discussed above, the standoff during each of the rapid sample periods can be recorded and associated with its corresponding rapid sample period. Each of the rapid samples within an azimuthal sector can be weighted according to the standoff at the time the sample was detected. Thus, the number of counts of an energy interval from a rapid sample is multiplied by a predetermined weighting factor. The weighting factor is preferably logarithmic and calculated to emphasize rapid samples within a sector with a small standoff while de-emphasizing the rapid samples with large standoff.

An exemplary weighting factor that can be adapted to the method of the present invention is disclosed in U.S. Pat. No. 5,486,695 to Schultz et al. which is hereby incorporated by reference in its entirety as if reproduced herein. The weighting factor in Schultz is disclosed as being applied to counts collected during a plurality of time periods. The counts of each time period are weighted and the weighted counts for an entire time series are summed. In the present invention, however, the method of Schultz is modified by weighting and summing counts collected in the rapid samples of a given sector, rather than a given period of time (i.e. time sample).

One of ordinary skill in the art will appreciate that other weighting factors exist. Such other weighting factors can be derived mathematically or determined quantitatively to account for standoff variances in each of the characteristics being measured. The scope of the present invention is intended to include other weighting factors.

After the counts of an energy interval in each rapid sample have been weighted according to standoff, a weighted count total can be calculated for each energy interval by summing the weighted counts. The resultant weighted count total can then be divided by the total time span of detection within the sector to determine a weighted count rate for the energy interval. The weighted count rate for one or more energy intervals within each sector can be transformed using known techniques to the one or more formation characteristics, for example density or Pe, to achieve image points in the formation characteristic. As above, the image log would consist of a representation of the measured characteristic for two or more sectors.

If two or more detectors 26 are used, such as a short space detector 26*a* and a long space detector 26*b,* the count rates of a given energy interval or different energy intervals from the two or more detectors 26 can be correlated, as discussed above, to account for the standoff of the detectors 26 from the borehole wall 28. Such correlation can be performed before the count rate from the one or more energy intervals is transformed into the one or more formation characteristics.

Another compensation strategy that does not require an association of standoff can be utilized. In this method, if the ratio of actual standard deviation to theoretical standard deviation is greater than the threshold value, the rapid samples can be weighted in accordance with the deviation of the sample from the mean number of samples $\overline{C}_{Sample}$.

In a density measurement, the weighting factor can also depend on the relative densities of the drilling mud and the formation. The weighting factor may be calculated to emphasize the rapid sample periods with a number of total counts that is less than the mean or emphasize the rapid sample periods with a number of total counts that is greater than the mean. If the mud density is lower than the formation density, the rapid samples having a total counts less than the mean should be emphasized, because in this situation a low count typically corresponds to a low standoff. If the mud density is greater than the formation density, the rapid samples having a total counts greater than the mean should be emphasized, because in this situation a high count rate typically corresponds to a low standoff.

After the counts in each rapid sample have been weighted according to deviation from the mean number of counts, the weighted counts within an azimuthal sector for a given energy interval are summed to produce a weighted count total for the given energy interval. The resultant weighted count total can then be divided by the total time span of detection within the sector to determine a weighted count rate for the given energy interval in the given sector. Similarly the weighted count total can be calculated for each energy interval.

The weighted count rate for one or more energy intervals within each sector can be transformed using known techniques into a representation of the one or more formation characteristics, for example density or Pe. The same formation characteristic can be derived for two or more sectors to produce an image of the borehole 16 circumference in the measured characteristic. As discussed above, the image would consist of a representation of the measured characteristic for each of the included sectors.

As above, when two or more detectors 26 are used, such as a short space detector 26*a* and a long space detector 26*b,* the count rates of an energy interval from the two or more detectors 26 can be correlated to account for the standoff of the detectors 26 from the borehole wall 28. Such correlation can be performed before the count rate from the one or more energy intervals is transformed into the one or more formation characteristics.

To derive a representative characteristic of a portion of the borehole 16 or the entire circumference of the borehole 16, the count totals from one or more sectors are used. The count totals from the included sectors are linearly summed to determine a count total for the included sectors. The count totals from each of the included sectors may or may not have been compensated using one of the methods described above. A count rate is calculated from the count total for the included sectors, and is then transformed into the particular formation characteristic of interest.

If, by reference to an image log, the formation characteristic of each of the sectors is relatively uniform, a representative characteristic for the entire circumference of the borehole 16 can be calculated including count data from all of the sectors. If the formation characteristic of each of the sectors is not relatively uniform, reference must be made to the image log to determine a pattern. For example, in measuring a representative density, if one or more adjacent sectors have a different density than the remaining sectors, this may indicate that the borehole is crossing a bed boundary at a high angle. In such a situation, the image log will reveal one density in the sectors on the "high side" of the tool, and another density in the sectors on the "low side" of the tool. To achieve the most accurate representative density, sectors of similar density values can be analyzed together determine one or more representative density measurements.

One method of determining whether to analyze groupings of sectors together, rather than analyzing the borehole as a whole, involves comparing the statistical precision of each sector against a standard deviation calculated for the samples collected over the whole borehole. If the distribution of the samples is greater than what would be expected from the inherent precision of the sectors, excepting normal statistical effects, then the samples can be separated, individually or by sectors, into two or more groups. The two or more groups can comprise samples having a similar deviation from the mean. Thereafter, one or more representative formation characteristics can be derived from each of the groups.

Although the methods of the invention have been described with respect to a gamma radiation LWD tool 10, one of ordinary skill in the art will appreciate that the energy source 24 and the detectors 26 can be configured to operate in other energy domains, for example but in no means by limitation, the energy source may be an acoustical emitter and the detectors may be acoustic detectors, or the source and detectors can be electrical to measure electrical characteristics of the formation such as resistivity.

It is to be understood that while the invention has been described above in conjunction with a few exemplary embodiments, the description and examples are intended to illustrate and not limit the scope of the invention. That which is described herein with respect to the exemplary embodiments can be applied to the measurement of many different formation characteristics. Thus, the scope of the invention should only be limited by the following claims.

What is claimed is:

1. A method of determining at least one characteristic of an earth formation surrounding a borehole using a rotating logging tool, the logging tool having at least one emitter for emitting energy into the earth formation and at least one detector for detecting energy reflected from the earth formation, the method comprising:

detecting energy during a plurality of sample periods with the detector to produce a plurality of samples corresponding to the sample periods, wherein the duration of each sample period is shorter than one half of the time required for the tool to complete a rotation;

measuring the azimuthal angle of the detector in at least one sample period;

measuring the standoff of the detector from the wall of the borehole in at least one sample period;

sorting the samples into groups, each group representative of the azimuthal sector of the borehole from which the sample was detected;

within a group, mathematically weighting each of the samples according to standoff;

within a group, mathematically summing the weighted samples to achieve a weighted sample total for a sector;

within a group, dividing the weighted sample total by the total duration of sample periods in the group to determine a detection rate for the sector; and transforming the detection rate for at least one sector into a representation of at least one formation characteristic.

2. The method of claim 1 further comprising transforming the detection rate for at least two of the sectors into the same formation characteristic to produce an image of the borehole with respect to the particular formation characteristic.

3. The method of claim 1 further comprising transforming the detection rate for one or more sectors into a representation of a representative formation characteristic of the borehole.

4. The method of claim 1 wherein the emitter emits gamma radiation and the detectors detect counts of backscattered gamma radiation.

5. The method of claim 4 wherein the at least one formation characteristic comprises density.

6. The method of claim 4 wherein the at least one formation characteristic comprises a lithology indicator.

7. The method of claim 1 wherein the borehole is divided into sixteen azimuthal sectors.

8. The method of claim 1 further comprising deriving a representation of a representative characteristic for at least two portions of the circumference of the borehole.

9. The method of claim 1 wherein the duration of each sample period is shorter than the time that the detector is in the azimuthal sector in one rotation of the tool.

10. The method of claim 1 wherein the energy is detected in a first energy interval and a second energy interval during the sample periods;

wherein the steps of mathematically weighting each of the samples according to standoff, mathematically summing the weighted samples, and dividing the weighted sample total by the total duration of the sample periods are performed with respect to the first energy interval and then with respect to the second energy interval; and wherein transforming the detection rate for at least one sector comprises transforming the detection rate for at least one energy interval for at least one sector into a representation of at least one formation characteristic.

11. A method of determining at least one characteristic of an earth formation surrounding a borehole using a rotating logging tool, the logging tool having at least one emitter for emitting energy into the earth formation and at least one detector for detecting energy reflected from the earth formation, comprising:

detecting energy during a plurality of sample periods with the detector to produce a plurality of samples corresponding with the sample periods, wherein the duration of each sample period is shorter than one half of the time required for the tool to complete a rotation;

measuring the azimuthal angle of the detector in at least one sample period;

sorting the samples into a plurality of groups, each group representing the azimuthal sector of the borehole from which each sample was detected;

within a group, calculating the mean of the samples;

within a group, calculating a theoretical standard deviation of the samples;

within a group, calculating an actual standard deviation of the samples;

within a group, mathematically weighting each of the samples according to the deviation of the sample from the mean and mathematically summing the weighted samples to produce a weighted sample total for a sector;

within a group, dividing the weighted sample total by the total duration of sample periods in the group to determine an detection rate for the sector; and transforming the detection rate for at least one sector into a representation of at least one formation characteristic.

12. The method of claim 11 further comprising:

within a group, if the ratio of the actual standard deviation to the theoretical standard deviation is below a given value, mathematically summing the samples to achieve a sample total for a sector; and within a group, dividing the weighted sample total by the total duration of sample periods in the group to determine a count rate for the sector.

13. The method of claim 11 further comprising transforming the detection rate for at least two of the sectors into the same formation characteristic to produce an image of the borehole with respect to the formation characteristic.

14. The method of claim 11 further comprising transforming the detection rate for one or more sectors into a representative formation characteristic of the borehole.

15. The method of claim 11 wherein the emitter emits gamma radiation and the detectors detect counts of backscattered gamma radiation.

16. The method of claim 15 wherein the at least one formation characteristic comprises density.

17. The method of claim 15 wherein the at least one formation characteristic comprises a lithology indicator.

18. The method of claim 11 wherein the step of sorting the samples into a plurality of groups comprises sorting the samples into sixteen groups.

19. The method of claim 11 wherein the duration of each sample period is shorter than the time that the detector is in the azimuthal sector in one rotation of the tool.

20. The method of claim 11 wherein the energy is detected in a first energy interval and a second energy interval during the sample periods;

wherein the steps of mathematically weighting each of the samples according to standoff, mathematically summing the weighted samples, and dividing the weighted sample total by the total duration of the sample periods are performed with respect to the first energy interval and then with respect to the second energy interval; and wherein transforming the detection rate for at least one sector comprises transforming the detection rate for at least one energy interval for at least one sector into a representation of at least one formation characteristic.

* * * * *